US007979181B2

(12) United States Patent
Clark et al.

(10) Patent No.: US 7,979,181 B2
(45) Date of Patent: Jul. 12, 2011

(54) VELOCITY BASED CONTROL PROCESS FOR A MACHINE DIGGING CYCLE

(75) Inventors: Megan Clark, Knoxville, IL (US); Chad Magstadt, Peoria, IL (US); Gregory Mettlach, Dunlap, IL (US); Robert J. Price, Dunlap, IL (US); Bassam J. Alshaer, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 1157 days.

(21) Appl. No.: 11/716,453

(22) Filed: Mar. 9, 2007

(65) Prior Publication Data

US 2008/0097672 A1 Apr. 24, 2008

Related U.S. Application Data

(60) Provisional application No. 60/852,809, filed on Oct. 19, 2006.

(51) Int. Cl.
*E02F 3/43* (2006.01)

(52) U.S. Cl. ..... 701/50; 414/685

(58) Field of Classification Search ..... 701/50; 414/710, 697, 699, 685; 172/2, 4, 4.5, 18; 37/907, 342, 348, 419, 414, 347, 314, 319, 37/417

See application file for complete search history.

(56) References Cited

U.S. PATENT DOCUMENTS

| | | | |
|---|---|---|---|
| 4,518,044 | A | 5/1985 | Wiegardt et al. |
| 4,608,873 | A | 9/1986 | Redzinski |
| 4,984,956 | A | 1/1991 | Ikari et al. |
| 5,065,326 | A | 11/1991 | Sahm |
| 5,105,985 | A | 4/1992 | Kroeber |
| 5,193,637 | A | 3/1993 | Lindblom |
| 5,214,916 | A | 6/1993 | Lukich |
| 5,438,771 | A | 8/1995 | Sahm et al. |
| 5,446,980 | A | 9/1995 | Rocke |
| 5,461,803 | A | 10/1995 | Rocke |

(Continued)

FOREIGN PATENT DOCUMENTS

| | | |
|---|---|---|
| EP | 0979901 | 2/2000 |

(Continued)

OTHER PUBLICATIONS

Pending publication of U.S. Appl. No. 11/094,527, filed Mar. 31, 2005, Automatic Digging and Loading System for a Work Machine.

*Primary Examiner* — Dalena Tran
(74) *Attorney, Agent, or Firm* — Liell & McNeil

(57) ABSTRACT

A method and machine with an automated digging cycle is provided. The method includes moving an implement system of the machine through a work cycle, including interacting with a material. The method further includes sensing values associated with a bucket velocity parameter, such as bucket tip velocity, during interacting with the material, and controlling the velocity parameter via commands which control a sequence of bucket orientations whereby an implement system of the machine interacts with the material, responsive to the sensed values. The machine includes an electronic controller configured via a control algorithm to execute the automated digging cycle. A velocity based control system for an excavating machine includes an electronic controller configured to receive velocity signals from at least one sensor, determine a bucket tip velocity, and output control commands to move a bucket of the excavating machine through a material via a sequence of bucket orientations that is based on the determined bucket tip velocity.

19 Claims, 7 Drawing Sheets

U.S. PATENT DOCUMENTS 5,493,798 A 2/1996 Rocke et al.
5,528,843 A 6/1996 Rocke
5,629,849 A 5/1997 Ahn
5,682,312 A 10/1997 Rocke
5,699,247 A 12/1997 Moriya et al.
5,720,358 A 2/1998 Christensen et al.
5,768,810 A 6/1998 Ahn
5,794,369 A 8/1998 Lee et al.
5,941,921 A 8/1999 Dasys et al.
5,950,141 A 9/1999 Yamamoto et al.
5,953,977 A * 9/1999 Krishna et al. ..... 91/361
5,968,103 A 10/1999 Rocke
5,974,352 A 10/1999 Shull
5,975,214 A 11/1999 Okamura et al.
5,987,371 A 11/1999 Bailey et al.
5,994,865 A 11/1999 Phelps et al.
6,032,093 A 2/2000 Denbraber et al.
6,064,933 A 5/2000 Rocke
6,065,904 A 5/2000 Cook et al.
6,098,322 A 8/2000 Tozawa et al.
6,101,437 A 8/2000 Oshina et al.
6,108,949 A 8/2000 Singh et al.
6,129,155 A 10/2000 Lombardi
6,131,061 A 10/2000 DenBraber et al.
6,140,787 A 10/2000 Lokhorst et al.
6,167,336 A 12/2000 Singh et al.
6,205,687 B1 3/2001 Rocke
6,208,925 B1 3/2001 Creger et al.
6,211,471 B1 4/2001 Rocke et al.
6,233,511 B1 * 5/2001 Berger et al. ..... 701/50
6,234,254 B1 5/2001 Dietz et al.
6,246,939 B1 6/2001 Nozawa
6,275,757 B1 * 8/2001 Watanabe et al. ..... 701/50
6,278,955 B1 8/2001 Hartman et al.
6,282,453 B1 8/2001 Lombardi
6,286,606 B1 9/2001 Krieg et al.
6,321,153 B1 11/2001 Rocke et al.
6,371,214 B1 4/2002 Anwar et al.
6,385,519 B2 5/2002 Rocke
6,502,498 B2 1/2003 Shull et al.
6,584,710 B1 7/2003 Felsing et al.
6,591,591 B2 7/2003 Coers et al.
6,879,899 B2 4/2005 Budde
6,938,535 B2 * 9/2005 Price ..... 91/361
2002/0152885 A1 10/2002 Shull et al.
2004/0083628 A1 5/2004 Hendron et al.
2004/0117092 A1 6/2004 Budde
2005/0102866 A1 5/2005 Sewell et al.

FOREIGN PATENT DOCUMENTS

EP 1323870 7/2003

* cited by examiner

VELOCITY BASED CONTROL PROCESS FOR A MACHINE DIGGING CYCLE

This Application claims the Benefit of the Filing Date of U.S. Provisional Application Ser. No. 60/852,809, filed Oct. 19, 2006.

TECHNICAL FIELD

The present disclosure relates generally to control processes and systems for machines having an implement system, and relates more particularly to a velocity based control process and system for operating a machine implement system in an automated digging cycle.

BACKGROUND

A wide variety of construction machines are used to perform digging and digging-related tasks such as trenching, material spreading, grading, etc. An excavating machine is one such device, and a conventional design employs a multi-part linkage coupled with a bucket for capturing and moving material during a digging cycle. Each of the linkage components and the bucket will typically have one or more actuators coupled therewith. Each of the actuators, or actuator groups, may be coupled with separate control levers or other input devices. When it is desirable to dig a trench, for example, an operator is tasked with independently controlling a plurality of parameters. For operations which are relatively lengthy, complex and/or repetitive, the operator may experience significant fatigue from operating the various controls repetitiously. Moreover, operating efficiency in a work cycle may be less than optimal given the inherent limitations of human coordination, concentration and stamina.

In an attempt to relieve operators of certain of the stresses of long term, repetitive machine control, and to improve efficiency, engineers have developed a variety of automated work cycle control systems and processes over the years. One conventional approach for automating a work cycle in an excavating machine utilizes force feedback and position data associated with the linkage and bucket components as a basis for generating actuator control commands to move the linkage and bucket. In general terms, such a system relies upon sensor inputs indicative of force experienced by the linkage and bucket components during interacting with a material such as soil, sand, gravel, etc.

Such force-based systems have performed relatively well in the past, however, they are not without limitations. In particular, excavating machines may be required to perform automated digging cycles in a variety of different material types. Each material type has varying characteristics, such as strength, mass, frictional interaction with the bucket, etc. For example, a relatively hard, clayey soil will tend to have significantly different force interaction characteristics with the bucket of an excavating machine than a relatively looser and softer material such as dry sand. This variance in material characteristics across material types necessitates relatively extensive tuning and/or adjustment of an excavating machine and its associated automated digging cycle control system. In other words, no practicable one-size-fits-all approach has been developed, with the result that conventional digging cycle control systems are often programmed via a plurality of different maps which correspond to a plurality of different material types, often following extensive field testing and tuning. It is thus desirable to develop a system that can be used in a variety of different material types without the extensive data collection and programming required with conventional systems.

The present disclosure is directed to one or more of the problems or shortcomings set forth above.

SUMMARY OF THE DISCLOSURE

In one aspect, the present disclosure provides a method of controlling a machine having an implement system that includes a linkage and a bucket coupled with the linkage. The method includes moving the implement system through a work cycle, including interacting with a material, and sensing values associated with a bucket velocity parameter during interacting with material. The method further includes controlling the bucket velocity parameter by controlling a sequence of bucket orientations whereby the implement system interacts with material. Controlling the bucket velocity parameter further includes outputting actuator control commands for at least one actuator of the implement system with an electronic controller of the machine responsive to the sensed values.

In another aspect, the present disclosure provides a machine including an implement system having a linkage with a boom and a stick, a bucket and a plurality of actuators. The machine further includes at least one sensor configured to sense values associated with a bucket velocity parameter, and an electronic controller. The electronic controller is coupled with the at least one sensor and with each of the actuators and is configured to control the bucket velocity parameter by controlling a sequence of bucket orientations whereby the implement system interacts with material responsive to signals from the at least one sensor.

In still another aspect, the present disclosure provides a control system for an excavating machine having an implement system that includes a linkage with a boom and stick, and a bucket. The control system includes at least one sensor configured to output signals indicative of a bucket velocity parameter. The control system further includes an electronic controller coupled with the at least one sensor. The electronic controller is configured to control the bucket velocity parameter by controlling a sequence of bucket orientations whereby the implement system interacts with material responsive to signals from the at least one sensor.

DETAILED DESCRIPTION

Figure 1:
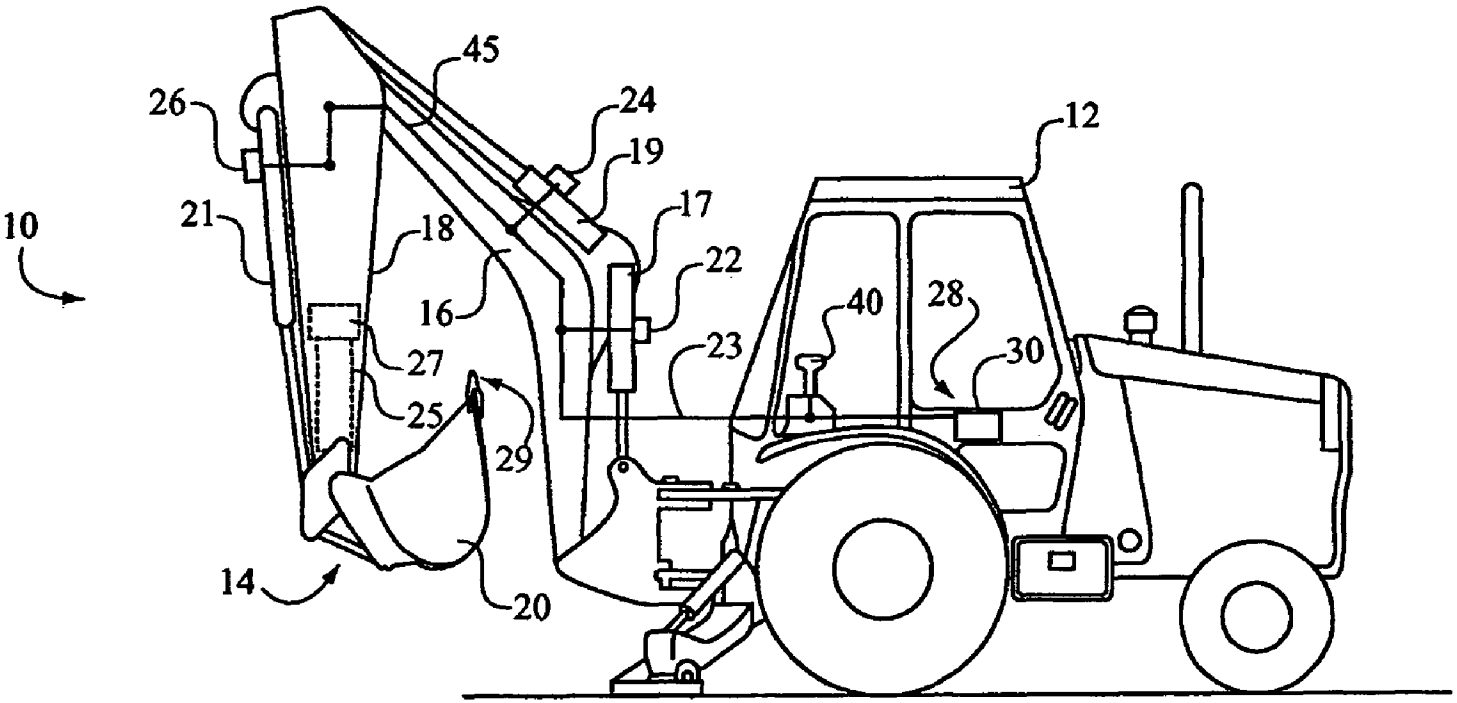
FIG. 1 is a side diagrammatic view of a machine and control system according to one embodiment of the present disclosure.

Referring to FIG. 1, there is shown a machine 10 having a control system 28, in accordance with one embodiment of the present disclosure. Machine 10 is illustrated approximately as it might appear in a start or tucked position, just prior to beginning performing a work cycle such as an automated digging cycle according to the present disclosure. Machine 10 is shown in the context of a backhoe-type excavator having a frame 12 with an implement system 14 coupled therewith, although the present disclosure is not thereby limited. Implement system 14 includes a boom 16, a stick 18 and a bucket 20 having a toothtip or bucket tip 29. It should be appreciated that other machine types such as tracked excavators, loaders, front shovels, etc., are contemplated as falling within the scope of the present disclosure. A plurality of actuators, which may be hydraulic actuators, are configured to move implement system 14 through a work cycle, comprising a boom actuator 17, a stick actuator 19 and a bucket actuator 21, for example. In certain machines according to the present disclosure, an E-stick 25 and E-stick actuator 27 may be housed within stick 18 and configured to extend bucket 20 outwardly from stick 18. An E-stick may also be used in conjunction with the presently described control process. Control system 28 includes a plurality of components whereby implement system 14 can be automatically controlled during at least a portion of work cycle, such as a portion that includes interacting with a material via digging, as described herein. Rather than a digging cycle, however, the present disclosure is also contemplated to be applicable to other machine operations such as spreading a pile of material with implement system 14.

Control system 28 may include an electronic controller 30 in communication with a first sensor 22 via a communication line 23, and configured to receive signals therefrom. Sensor 22 may comprise a sensor such as a position sensor configured to sense position values that may be processed over time into values indicative of a velocity of boom actuator 17, in turn indicative of a velocity of boom 16 relative to frame 12 or some other reference. Position inputs from sensor 22, and the other sensors described herein, may also be used to determine a relative position or angle of the respective components of implement system 14. It should further be appreciated that rather than linear position sensors, rotary position sensors, velocity sensors or some other sensor type such as optical sensors might be used to determine values indicative of velocity of the components of implement system 14. In most embodiments, however, at least one sensor configured to communicate signals indicative of a bucket velocity parameter, for example bucket tip velocity, to electronic controller 30 will be used. The relative velocity of boom movement relative to frame 12, or another reference, may be understood as a boom-up or boom-down operating parameter, and electronic controller 30 may be configured to output boom-up and boom-down control signals to actuator 17 to move boom 16 as desired.

Control system 28 may also include a second sensor 24, which may be similar to sensor 22, and configured to sense stick position, which may be processed over time into values indicative of a velocity of stick actuator 19, and hence a velocity of stick 18. The relative velocity of movement of stick 18 relative to boom 16, frame 12 or some other reference may be understood as a stick-in or stick-out operating parameter, depending on the direction of stick movement, electronic controller 30 being configured to output stick-in and stick-out control signals to actuator 19 to move stick 18 as desired. Sensor 24 may be in communication with electronic controller 30 via another communication line 45.

A bucket actuator sensor 26 may also be provided, and configured to sense bucket position, which may be processed over time into values indicative of a velocity of actuator 21, and hence a velocity of rotation of bucket 20. The velocity of bucket rotation relative to stick 18 or some other reference may be understood as a bucket-curl operating parameter for movement in a first direction, and a bucket-rack operating parameter for movement in a second, opposite direction, electronic controller 30 being configured to output corresponding bucket-curl and bucket-rack control signals to actuator 21 to move bucket 20 as desired. Thus, references herein to bucket-curl may be understood as referring to a rate of bucket rotation relative to stick 18, or another reference. Sensor 26 may also be coupled with electronic controller 30 via communication line 45. Implementation of certain aspects of the present disclosure may include determining values of the boom-up/down, stick-in/out and bucket-curl velocity parameters, as well as determining relative angles between the various components, via known kinematic measurement techniques. In contrast to earlier designs, however, the present disclosure may be implemented without a need for determining any force feedback values associated with implement system 14 to successfully automate a work cycle or a portion thereof. A system having supplementary use of force feedback and/or hydraulic pressures, however, may still fall within the scope of the present disclosure.

Electronic controller 30 may be configured to receive inputs from each of sensors 22, 24 and 26 and thereby determine, calculate or estimate the value of a selected bucket velocity parameter, for example via velocity and/or position inputs provided by sensors 22, 24 and 26. To this end, each of sensors 22, 24 and 26 may repetitively output position signals associated with the respective actuators, such that electronic controller 30 can determine actuator velocity based on differing sensed positions over time, and hence determine a bucket velocity parameter value. The bucket velocity parameter value may be, for example, bucket tip velocity in at least two dimensions, determined either by calculating bucket tip velocity based on the sensor inputs, or by referencing mapped data corresponding to inputs associated with actuators 17, 19 and 21 and optionally swing actuators (not shown) associated with boom 16. Embodiments are also contemplated wherein E-stick 25 is used, and sensing of E-stick position and/or velocity values may be incorporated into the determination of the subject bucket velocity parameter value. E-stick velocity based controls might also be used in an automated digging/trenching cycle according to the present disclosure.

An operator input device 40 is also included in machine 12, and may be configured to output control commands to implement system 14, and/or activate a digging cycle control mode according to the present disclosure, as described herein. Input device 40 may include a trigger, switch or similar device which may be actuated to activate the control process of the present disclosure. In certain embodiments, an operator may perform part of a work cycle manually, allowing electronic controller 30 to take over via automated operation during a portion of the work cycle. For example, in some instances, it may be desirable to automate a digging portion of a work cycle, or only part of a digging portion, while leaving other portions of the work cycle such as swinging to dump, dumping and returning to trench to operator control.

A control process according to the present disclosure may include moving implement system 14 through a work cycle, including interacting with material such as soil, gravel, etc. via a sequence of bucket orientations. As alluded to above, interacting with material may include interacting via a digging mode of a work cycle such as an automated trenching or other digging cycle, as described herein. A selected bucket velocity parameter, such as bucket tip velocity, may be controlled at least in part by outputting commands with electronic controller 30 to at least one of actuators 17, 19 and 21 to control the sequence of bucket orientations whereby implement system 14 interacts with material, responsive to inputs from sensors 22, 24 and 26.

Figure 3B:
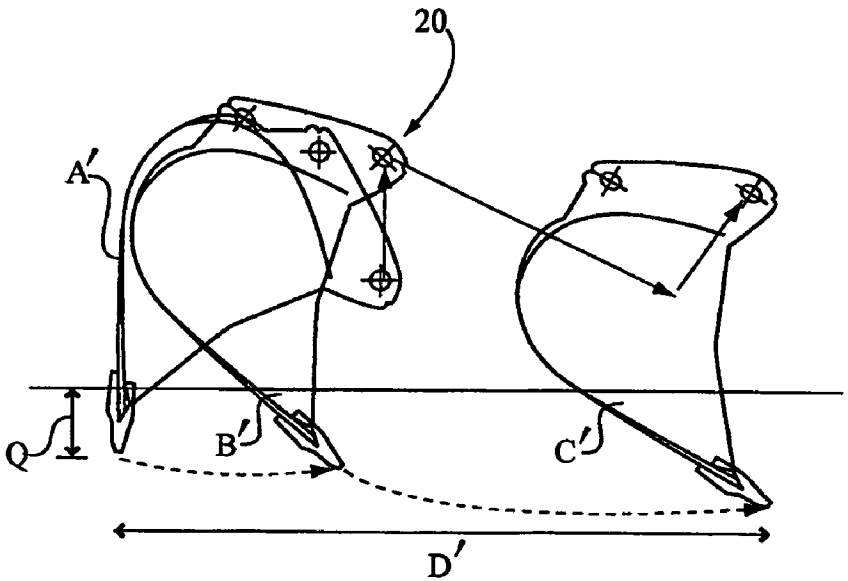
FIG. 3*b* is a side diagrammatic view of a bucket shown in a different sequence of orientations during a work cycle according to the present disclosure.
Figure 3A:
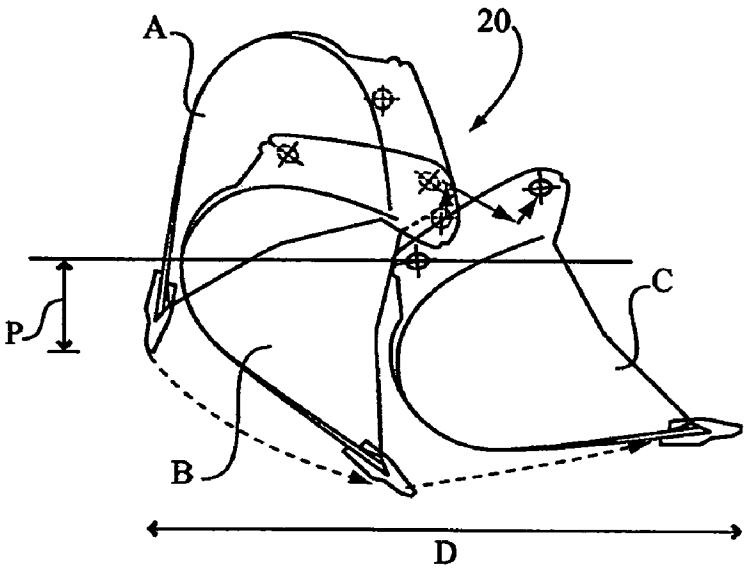
FIG. 3*a* is a side diagrammatic view of a bucket shown in a sequence of orientations during a work cycle according to the present disclosure.

Varying the sequence of orientations of bucket 20 by varying a sequence of velocity commands to one or more of actuators 17, 19 and 21, as bucket 20 interacts with a work material will enable bucket tip velocity, or another bucket velocity parameter value, to be maintained at or close to a desired velocity as bucket 20 moves through the material. In other words, velocity commands to actuators 17, 19 and 21 will define a sequence of bucket orientations during the digging cycle. The sequence of bucket orientations may in turn define a path that bucket tip 29 follows through material. Varying the respective actuator velocity commands responsive to sensed bucket tip velocity, for example, will result in a sequence of bucket orientations and, hence bucket tip path, that can best enable maintaining bucket tip velocity at or above desired velocity, as further described herein. Under certain conditions, the bucket orientation throughout a digging cycle could be relatively constant, although in one practical implementation strategy, the bucket orientations will change throughout the digging cycle, as relatively faster or relatively slower sensed bucket tip velocity may be compensated for by velocity commands to actuators 17, 19 and 21 which result in variation in the bucket tip orientation sequence, and hence a relatively longer, shorter, or varying bucket tip path. Target velocities for the individual actuators may be based on a desired bucket tip velocity and the dimensions and capabilities of system 14.

Where material with which bucket 20 is interacting is relatively harder, bucket tip velocity through the material may be maintained by outputting appropriate control commands to at least one of actuators 17, 19 and 21. In particular, for relatively harder material, a relatively slower bucket-curl may be commanded, and a relatively faster boom-up. In one embodiment, relatively slower bucket-curl and relatively faster boom-up will result in a relatively longer digging path distance of bucket 20 through the material. Thus, for relatively harder material, the overall sequence of bucket orientations may be thought of as similar to a relatively shallow scraping motion, with slower rotation of bucket 20 to avoid a risk of bucket 20 heeling and to optimize the ability of bucket 20 to cut through material without unduly slowing down. In contrast, where the material with which bucket 20 is interacting is relatively softer, bucket tip velocity through the material may be maintained by outputting relatively faster bucket-curl commands and relatively slower boom-up commands, resulting in a relatively shorter, deeper digging path, capturing material in bucket 20 relatively quickly and allowing lifting of captured material out of a trench relatively rapidly. In other words, the relative ease of filling a volume of bucket 20 with relatively softer material will be taken advantage of, whereas relatively greater effort required to capture a load of relatively harder material will be addressed with more of a scraping action to facilitate breaking the material apart. FIG. 3*a* illustrates a relatively shorter, deeper digging path via a first sequence of bucket orientations, whereas FIG. 3*b* illustrates a relatively longer, shallower digging path via a second, different sequence of bucket orientations, as further described herein.

It should be appreciated that regardless of the sequence of bucket orientations implemented, system 14 will typically be operated to maintain bucket tip velocity at or close to a desired velocity. Thus, varying the sequence of bucket orientations, and bucket tip path in many instances, may be understood as enabling controlling bucket tip velocity toward a desired velocity. It should further be appreciated that while the present disclosure contemplates outputting commands to control/vary the sequence of bucket orientations, the described "varying" is not based on any predetermined sequence. Rather, the result of controlling bucket, e.g. bucket tip, velocity as described herein will be a sequence of orientations which may not be known or even readily ascertainable until a digging cycle is performed via the presently described velocity based controls.

The desired or target bucket tip velocity may be empirically determined, for example, via a plurality of test sequences where a volume of material moved is measured in relation to elapsed time. Thus, a series of test digs might be made which move bucket tip 29 through material relatively faster, and relatively slower, and the time required to move X amount of material recorded. It has been discovered that relatively faster bucket tip velocities may be indicative of less material resistance, and consequently less capturing of material. If desired bucket tip velocity is set too high, an excessive number of digging passes may be necessary, as a lesser amount of material may be moved in each pass, increasing job time. Relatively slower bucket tip velocities may be indicative of greater interaction with material, and greater capturing of material per pass, however, a work cycle may take overly long if bucket tip velocity is too slow. Moreover, too slow a bucket tip velocity may indicate that a full bucket is being pushed through material in the trench, wasting effort. A balance may be struck between extremes of bucket tip velocity such that an optimal amount of material per unit of time may be moved with each of a plurality of digging passes, allowing completion of a trench or other dig in the shortest practicable amount of time, given the capabilities of the machine such as engine power, hydraulic stall and machine stability.

Figure 5:
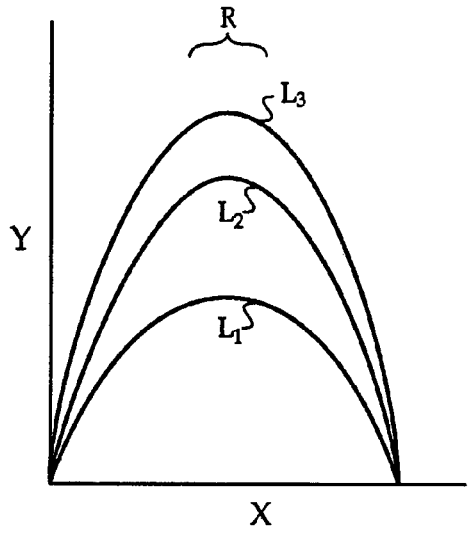
FIG. 5 is a graph illustrating bucket tip velocity compared to power for three different material types, according to the present disclosure.

Desired bucket tip velocity may be further understood as being based on a power interaction of the bucket with material. A relatively fast moving bucket may be moving relatively little material, and thus have a relatively low power interaction with the material, whereas a relatively slow moving bucket may be moving more material, but at such a slow velocity that it too has a relatively low power interaction with the material. Referring to FIG. 5, there is shown a graph wherein the Y-axis represents power into soil, as defined for example by the product of actuator force and velocity during a digging pass. The X-axis represents bucket tip velocity for three different soil types, $L_1$, $L_2$ and $L_3$, having increasing soil hardnesses, respectively. The graph illustrates a zero velocity at the left end of the X-axis, and a maximum attainable velocity toward the right end of the X-axis. Zero bucket tip velocity will indicate that no work is being done, i.e. no digging, whereas maximum attainable velocity will generally indicate zero resistance, and hence also no work being done with regard to moving soil. In the embodiment illustrated in FIG. 5, a range R may exist approximately about a mid-point of each of lines $L_1$, $L_2$ and $L_3$ that represents an optimum bucket tip velocity range. It will be noted that the peaks of each of lines $L_1$, $L_2$ and $L_3$ are generally associated with the same bucket tip velocity, reflecting an optimum bucket tip velocity regardless of soil type. Accordingly, a desired bucket tip velocity may be approximately the same across different material types, resulting in elimination or at least substantial reduction in tuning requirements, and increased applicability of the present disclosure to different machine types and sizes, as compared to certain conventional strategies. The particular target velocity selected may also depend upon other factors, such as fuel consumption, relative strength of various implement system components, etc. Thus, while a theoretical optimally efficient bucket tip velocity may be defined by peaks of lines $L_1$, $L_2$, and $L_3$ in the FIG. 5 illustration, corresponding approximately to one half of the bucket tip velocity achievable, other factors may shift the optimum velocity and/or optimum velocity range in some instances. Further, it may be noted that the relative steepness of lines $L_1$, $L_2$, and $L_3$ differs in FIG. 5. As power into soil, Y, increases, the relative breadth of range R may decrease, given the greater changes in power, and hence operating efficiency, which correspond to a given change in bucket tip velocity. Thus, for a particularly hard soil, range R might be relatively narrower, whereas for a particularly soft soil, range R might be relatively broader, the differences in breadth of range R corresponding to differing steepnesses of line $L_1$, $L_2$, and $L_3$.

A work cycle such as an automated trenching or other digging cycle according to the present disclosure may comprise a plural mode work cycle whereby implement system 14 is moved via a plurality of separate phases or modes, and controlled based on determined bucket tip velocity such that material is dug, captured, dumped, etc. in as efficient a manner as practicable. From the tucked position for machine 10 shown in FIG. 1, implement system 14 may be moved to an initial position such that it is positioned over a desired trenching location. Typically, the configuration of system 14 will be a maximum reach configuration at the initial position, however, user specifications may be varied, depending upon the application, machine capabilities and the length of a trench to be dug. In addition, the use of E-stick extension, where machine 10 is equipped with an E-stick may be controlled to vary the reach configuration.

Figure 2:
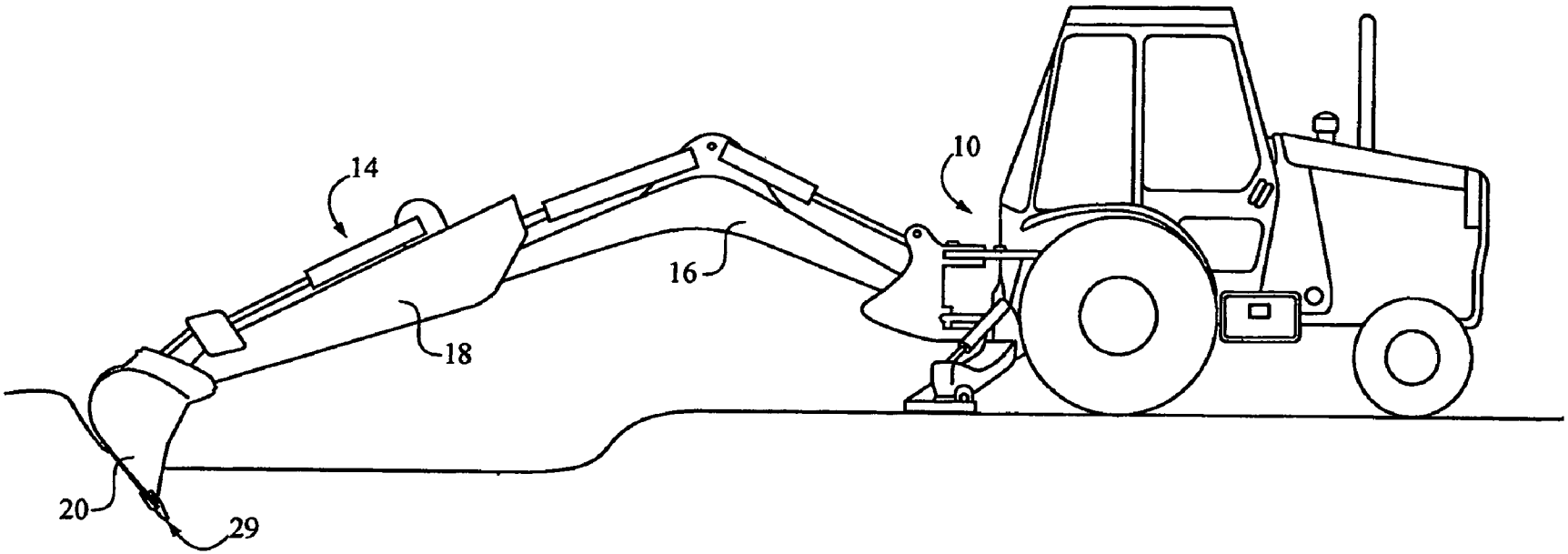
FIG. 2 is a side diagrammatic view of the machine of FIG. 1 shown in a different configuration from that of FIG. 1.

From a position above a desired trenching location, system 14 may be moved via a boom down mode to lower bucket 20 to a desired height above the ground, or above the floor of an existing trench. Following or coinciding with the boom down mode, bucket 20 may be curled to an insertion angle, which may be user specified, and then lowered to a desired digging depth, approximately as shown in FIG. 2. If bucket 20 does not reach a desired digging depth, the boom-down command may be increased and/or the control process may simply move ahead to the next phase, a bucket positioning mode. In a bucket positioning mode, bucket 20 may be curled to an optimum bucket angle, which may be user specified, to start the digging mode. If difficulty is encountered in curling bucket 20 to the desired angle, e.g. a stuck condition is encountered, bucket-curl may be increased, and if necessary boom-up may be initiated or increased to achieve a desired angle. Velocity commands to actuators 17, 19 and 21 might be incrementally increased until a stuck condition is overcome; alternatively, actuators 17, 19 and 21 might be used to reverse direction to overcome a stuck condition, or velocity commands incrementally decreased where bucket tip velocity is too high. It should be appreciated that in a full-cycle automated trenching embodiment, several or all of the discrete modes might be combined. For example, boom-down, bucket-positioning, etc. might take place together.

Referring to FIGS. 3*a* and 3*b*, there are shown separate sequences of bucket orientations, A, B and C, and A', B' and C', respectively, which may be implemented preceding and during a digging mode for relatively softer material (FIG. 3*a*) and relatively harder material (FIG. 3*b*). It will be noted that in FIG. 3*a*, bucket 20 has penetrated a first distance, P, whereas in FIG. 3*b*, bucket 20 has penetrated a second, smaller distance Q. The differing depths of penetration correspond with differing material hardness encountered during lowering boom 16. It may also be noted that a digging path distance D is relatively shorter in FIG. 3*a* than a digging path distance D' in FIG. 3*b*, again as would be expected for relatively different material hardness, as described herein. Sensed/determined bucket tip velocity will be indicative of a relative material hardness parameter. Thus, depending upon a material hardness factor, as indicated by determined bucket tip velocity values, for example, the velocity commands controlling the sequence of bucket orientations implemented for a given digging pass may vary. In general, but not necessarily, it may be desirable to maintain a relatively straight-line bucket tip motion during digging, i.e. keeping bucket tip 29 at an approximately constant elevation. The digging pass may be considered completed where either stick 18 reaches an end of its desired range of motion, corresponding approximately to bucket position C' in FIG. 3*b*, or where bucket 20 has achieved a maximum bucket angle at which it will not heel, corresponding approximately to bucket position C in FIG. 3*a*.

It should be appreciated that while the bucket orientation sequences shown in FIGS. 3*a* and 3*b* represent two possible bucket orientation sequences, they are exemplary only, and the bucket-curl, boom-up and in certain embodiments stick-in parameters may be varied to provide an infinite number of potential bucket orientation sequences during digging, responsive to material hardness. The use of an extensible e-stick may provide still further flexibility to the potential bucket orientation sequences.

Following execution of the digging mode, material may be captured, implement system 14 swung to a dump location/orientation and material dumped from bucket 20. In general, boom 16 may be raised from a trench until bucket 20 reaches a specified swing height, then boom 16 rotated relative to frame 12 toward a boom dump angle, lateral of the trench. In some instances, it may be desirable to output a slight stick-out command prior to completing capturing material with bucket 20 to minimize material spillage out of bucket 20. A precapture mode/phase may also be included wherein components of implement system 14 may be further controlled to avoid spillage, including slowing stick 18 as it approaches a position it occupies at the end of a digging pass. Following swinging boom 16 to a dump position, boom 16 will typically continue to be raised until reaching a specified dump height, and bucket 20 rotated, i.e. uncurled or "racked," to dump the captured material. Thenceforth, system 14 may be returned to an orientation suitable for initiating another work cycle. If multiple digging passes are not specified, then the dig may be ended.

Implementation of the control process of the present disclosure may take place via an automated digging cycle control algorithm recorded on a computer readable medium such as RAM, ROM or another medium of electronic controller 30. Alternatively, certain of the operations described herein may be controlled via dedicated hardware.

INDUSTRIAL APPLICABILITY

Figure 4A:
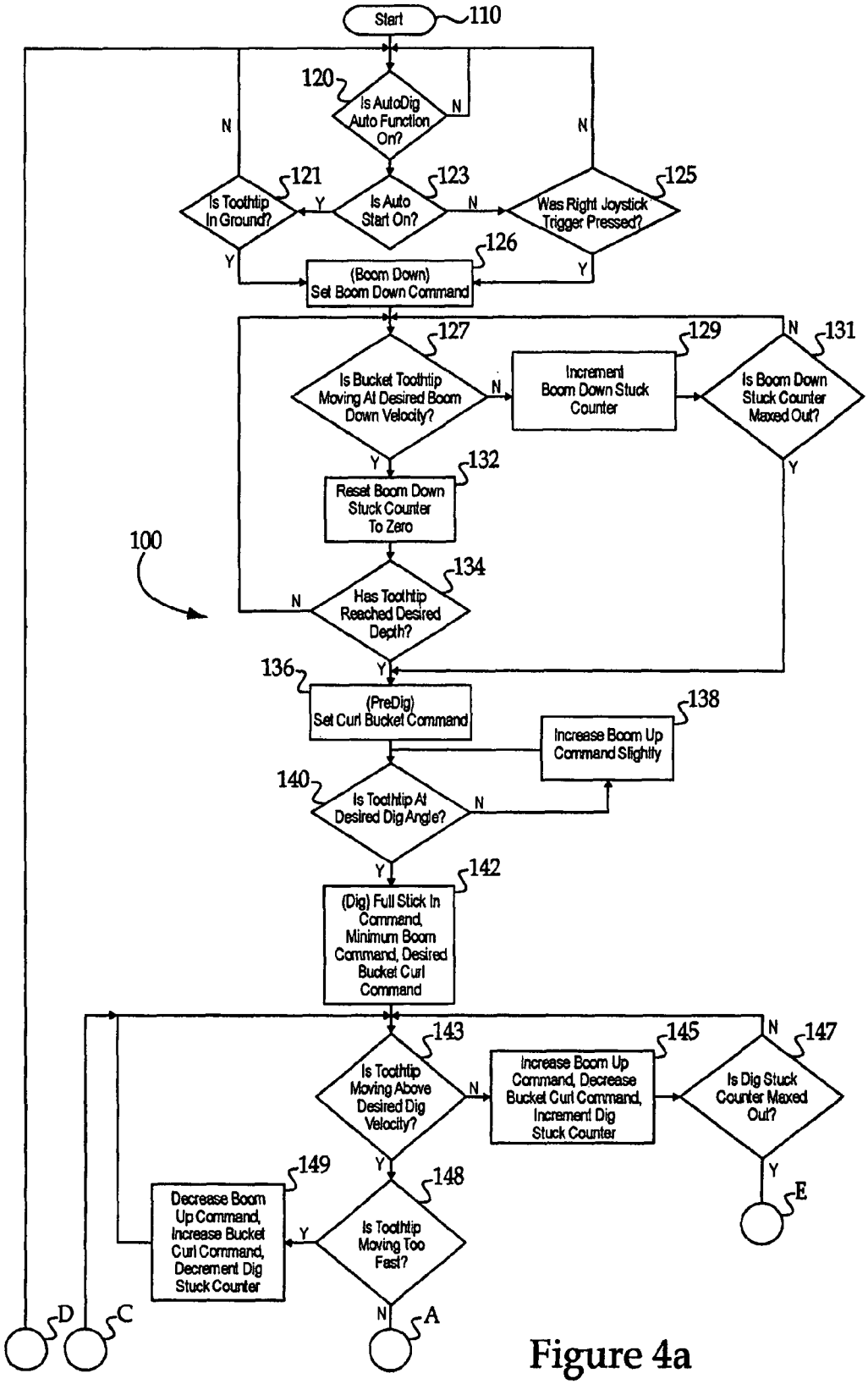
FIGS. 4*a-c* illustrate a flowchart according to an exemplary control process of the present disclosure.
Figure 4B:
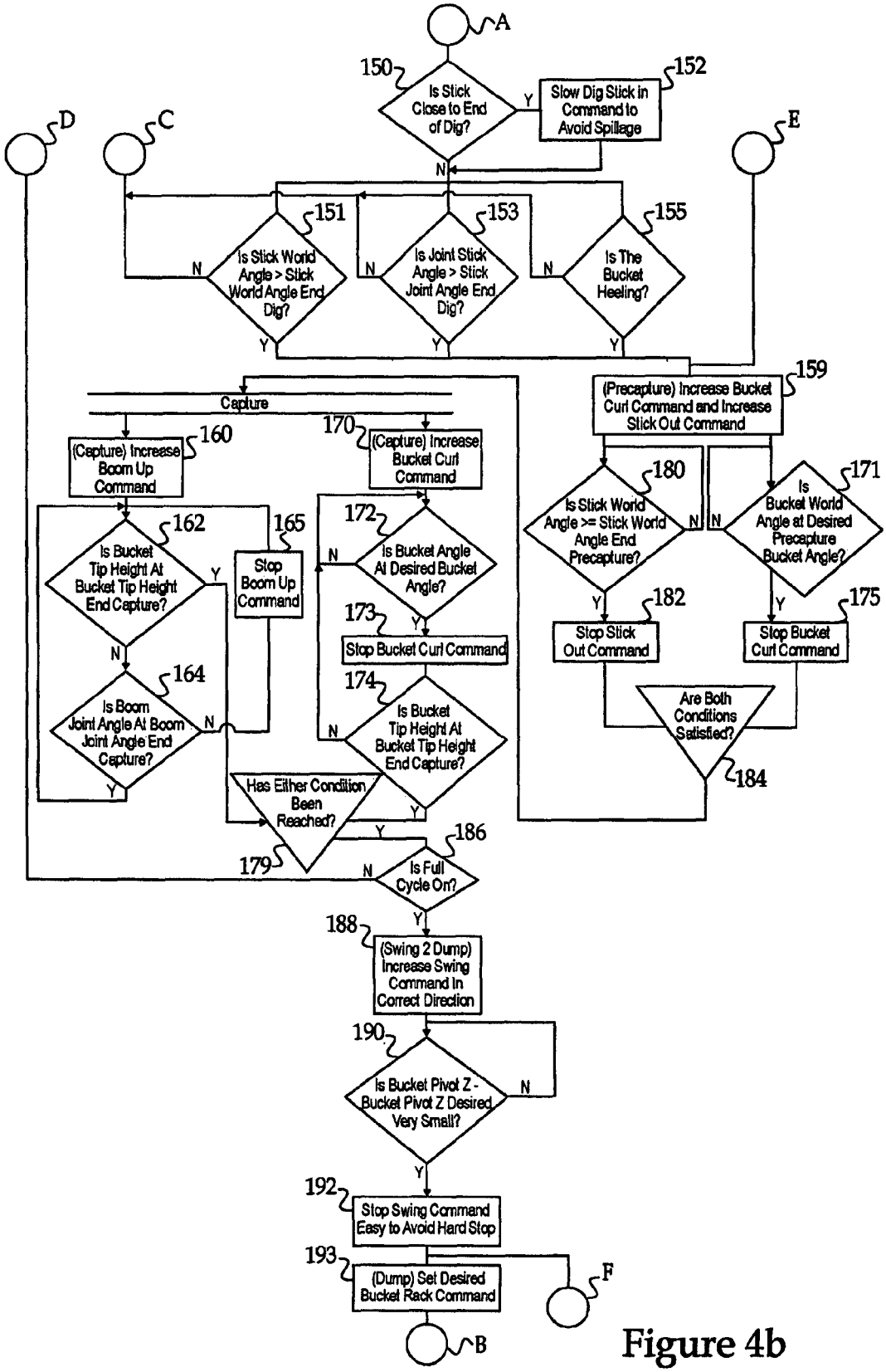
Figure 4C:
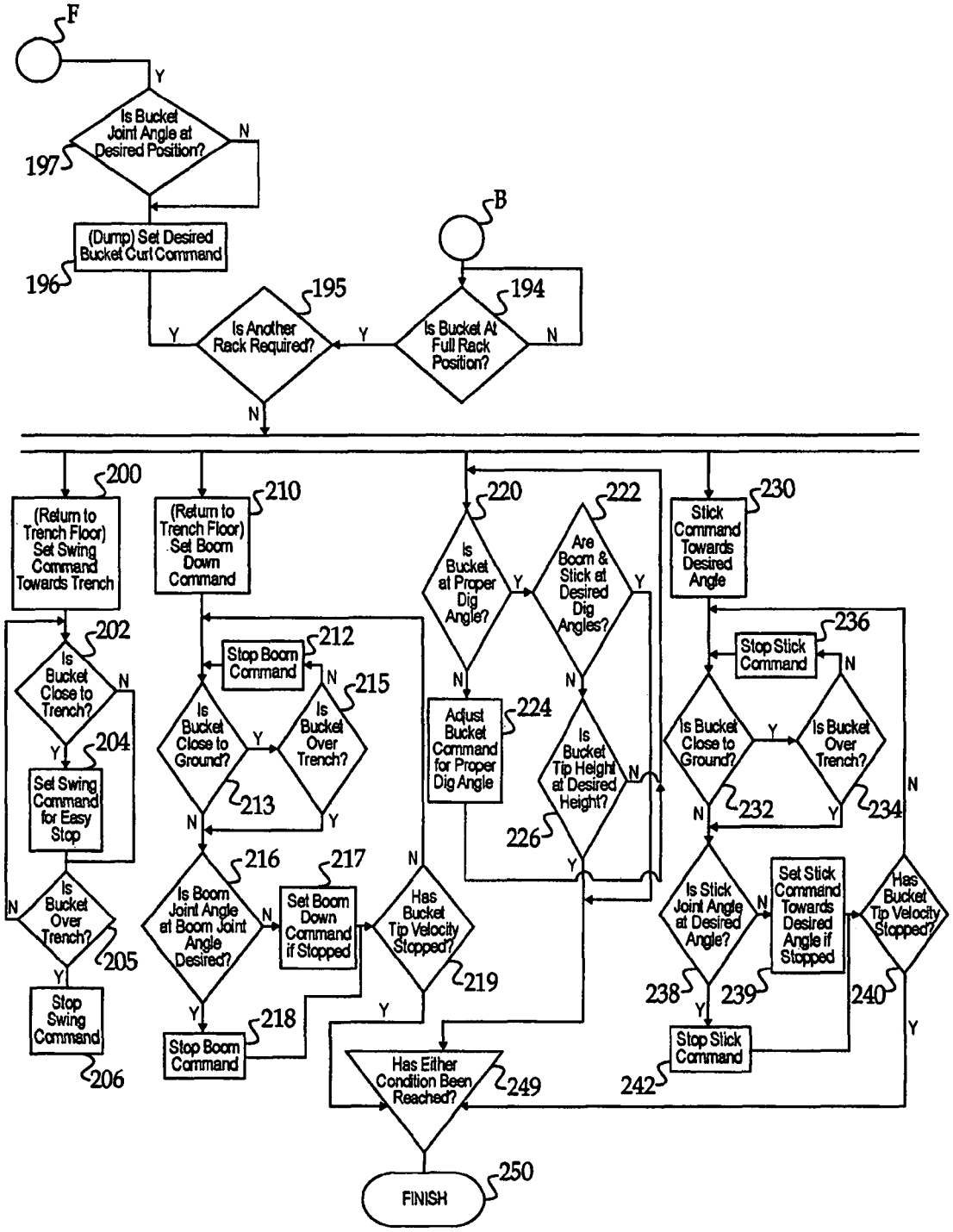

FIGS. 4*a-c* illustrate a control process 100 according to one exemplary embodiment of the present disclosure. Control process 100 may begin at step 110, Start, and may thenceforth proceed to step 120 wherein electronic controller 30 may query whether an autodig autofunction is on. If no, process 100 may return to again query whether an autodig autofunction is on, or may exit. If at step 120 autodig autofunction is on, process 100 may proceed ahead to step 123, wherein electronic controller 30 may query whether autostart for an automated digging cycle is on. Autostart may automatically initiate an automated portion of a cycle, or fully automated digging/trenching cycle, where certain predetermined conditions are met such as linkage movements or positions. If autostart is on, process 100 may proceed to step 121 to determine if bucket tip 29 is in the ground, for example by determining its velocity. If the determined velocity of tip 29 is zero, or below a threshold velocity, it may be determined that tip 29 is in the ground. If no, process 100 may return to step 120. If at step 121, bucket tip 29 is determined to be in the ground, it may be concluded that an operator has initiated digging on his or her own, and the control process may take over to automate at least a portion of the subsequent digging cycle, and proceed ahead to step 126. If at step 123, autostart is not on, process 100 may continue to step 125 to query whether a right joystick trigger, an activation trigger for the automated portion of the work cycle, has been pressed. In other words, electronic controller 30 may query in step 125 whether an operator has activated the automated portion of the work cycle apart from an autostart feature. If at step 125, the right joystick trigger is not pressed, or another operator activation request is not received, process 100 may return to step 120. If at step 125, an operator activation request has been received, process 100 may proceed to step 126. Steps 121, 123 and 125 may be understood as determining whether one of two initiation means for an automated portion of a work cycle is satisfied, namely, whether an operator has initiated the digging cycle, step 121, in conjunction with autostart, step 123, or whether a manual activation has occurred as determined in step 125.

In step 126, electronic controller 30 may set a boom down command, via adjusting fluid flow/pressure to boom actuator 17. From step 126, process 100 may proceed to step 127 wherein electronic controller 30 may query whether bucket tip or "toothtip" 29 is moving at a desired boom down velocity. If no, process 100 may proceed to step 129 to increment a boom down stuck counter. From step 129, process 100 may proceed to step 131 wherein electronic controller 30 may query whether the boom down stuck counter is maxed out. If no, process 100 may return to step 127. If at step 131 the boom down stuck counter is maxed out, process 100 may proceed ahead to step 136. If at step 127, bucket tip 29 is moving down at a desired boom down velocity, process 100 may proceed to step 132 to reset the boom down stuck counter to zero, and thenceforth to step 134 to query whether bucket tip 29 has reached a desired depth. In step 134, inputs from each of sensors 22, 24 and 26 may be used to determine whether bucket tip 29 has reached a desired depth, i.e. a depth that is appropriate for initiation of a digging portion of the automated work cycle. It should be appreciated that as a multiple pass digging cycle progresses, the desired depth for bucket tip 29 at step 134 will typically be a progressively lower depth, as trenching proceeds. If no, process 100 may return to step 127. If yes, process 100 may proceed to step 136 to set a curl bucket command to curl bucket 20 toward a desired digging angle. Steps 126-134 may be understood to correspond to a boom down mode of the work cycle, where the work cycle is divided into separate modes.

From step 136, process 100 may proceed to step 140 wherein electronic controller 30 may query whether bucket tip 29 is at a desired dig angle. If no, process 100 may proceed to step 138 wherein a boom-up command may be increased slightly to assist in curling bucket 20, and thenceforth return to step 140. If bucket tip 29 is at a desired dig angle in step 140, process 100 may proceed to step 142 to initiate digging, for example via a full stick-in command, a minimum boom-up command, and a bucket-curl command, for example about 35% of a maximum bucket curl command. For relatively harder material, bucket 20 may need to be relatively more slowly curled, and boom-up will be commanded at a relatively greater velocity, whereas relatively more bucket-curl and relatively less boom-up may be commanded for relatively softer material. The actual hardness of work material will not ordinarily be determined, however, bucket and boom velocity commands will generally be made which are a result of the relative hardness of the work material, as relatively harder material versus relatively softer material will affect the velocity of bucket tip velocity differently.

From step 142, process 100 may proceed to step 143 wherein electronic controller 30 may query whether bucket tip 29 is moving above a desired dig velocity. If bucket tip 29 is not moving above a desired dig velocity in step 143, electronic controller 30 may increase a boom-up command, decrease a bucket-curl command and increment a dig stuck counter in step 145. From step 145, process 100 may proceed to step 147 to query whether the dig stuck counter is maxed out. If yes, process 100 may proceed to step E. If at step 147 the dig stuck counter is not maxed out, process 100 may return to step 143. If at step 143, bucket tip 29 is determined to be moving above a desired dig velocity, process 100 may proceed to step 148 to query whether bucket tip 29 is moving too fast. If yes, process 100 may proceed to step 149 wherein electronic controller 30 may decrease a boom-up command, increase a bucket-curl command and decrement a dig stuck counter. Process 100 may return from step 149 to step 143. Process 100 may loop through steps 143, 148 and 149, or through steps 143, 145 and 147, a plurality of times, incrementally increasing or decreasing the respective parameters to control bucket tip velocity and/or alleviate a stuck condition. Repetition of the steps will result in incrementally increasing velocity commands if tip 29 is moving too slow, and incrementally decreasing velocity commands if tip 29 is moving too fast, in at least certain embodiments.

If bucket tip 29 is not moving too fast at step 148 process 100 may proceed to step 150, wherein electronic controller 30 may query whether stick 18 is close to an end of dig position. From step 150, process 100 may proceed to step 152, if stick 18 is close to end of dig, and slow the dig stick-in command to avoid spillage. From either of steps 150 and 152, process 100 may proceed to steps 151, 153 and 155 in parallel. It should further be appreciated that steps 145 and 147 may be understood as utilizing boom actuation to break bucket 20 from a stuck position. Thus, where bucket velocity is too slow, control commands to boom actuator 17 may be used to break the bucket out, and if the dig stuck counter is maxed out, in step 147, the material load can be captured for dumping, or the process may simply exit as bucket 20 may be stuck and need to be reversed, or otherwise controlled to address a stuck condition. In certain embodiments velocity commands may be increased in increments, where bucket tip velocity falls below a desired velocity, until the velocity increases indicating the bucket is unstuck.

In steps 151, 153 and 155, electronic controller 30 may be understood as determining whether conditions are satisfactory for capturing a load and raising bucket 20 from the trench. If at least one of the conditions is satisfied in steps 151, 153 and 155, process 100 may proceed ahead to a precapture portion of the work cycle, in steps 159-184, and thenceforth to a capture portion in steps 160-179. In step 151 in particular, electronic controller 30 may determine whether a stick world angle is greater than a stick world angle that corresponds with an end of a dig. If no, process 100 may return to the velocity and bucket orientation determinations in earlier steps 143-150, via step C. In step 153, electronic controller 30 may query whether stick joint angle is greater than a stick joint angle corresponding to the end of dig. If no, process 100 may return to steps 143-150. In step 155, electronic controller 30 may query whether bucket 20 is heeling. Heeling may be understood as a condition wherein the bucket is being moved through material in a manner such that it is not cutting, in other words where the bucket orientation is such that bucket tip 29 is not cutting through material and a rounded back of bucket 20 is pushing material rather than allowing bucket 20 to cut and capture material as it is moved. In general terms, the digging portion will be ended, and material capture and dump ultimately proceed, where stick 18 is positioned about 90 degrees to ground, i.e. its world angle is about 90°, or where a stick joint angle relative to boom 16 is less than a threshold angle corresponding to end of dig, or where bucket 20 is heeling.

If any of steps 151, 153 and 155 are true, then process 100 may proceed to step 159, the beginning of a precapture phase, wherein a bucket curl command is increased, and a stick out command is increased or set. From step 159, process 100 may proceed to steps 180 and 171 in parallel. At step 180, electronic controller 30 may query whether stick world angle is greater than or equal to a stick world angle for the end of precapture. If no, process 100 may return to execute step 180 again. If yes, process 100 may proceed to step 182 and stop the stick out command. At step 171, electronic controller 30 may query whether bucket world angle is at a desired precapture bucket angle. If no, process 100 may return to execute step 171 again. If yes, process 100 may proceed to step 175 to stop the bucket curl command. From both of steps 175 and 182, process 100 may proceed to step 184, wherein electronic controller 30 may query whether both conditions, of steps 182 and 175, are satisfied. From step 184, process 100 may proceed to steps 160 and 170 in parallel, to initiate a capture portion of the work cycle. Prior to initiating steps 160 and 170, however, a plurality of determinations may be made such that electronic controller 30 will be able to return implement system 14 to a start position above the trench if the automated digging cycle is continued. In other words, electronic controller 30 may record a boom angle, bucket tip height and stick angle, and any other necessary parameters such that after dumping a captured load, implement system 14 may be returned to a position above the trench, and thenceforth be moved to position bucket 20 at a desired position in the ground, accounting for removed work material via a bucket tip height adjustment factor.

In step 160, to capture material, electronic controller 30 may increase a boom-up command, and process 100 may then proceed to step 162 to query whether bucket tip height is at a bucket tip height corresponding to end of capture. If yes, process 100 may proceed ahead to step 179. If no, process 100 may proceed to step 164 wherein electronic controller 30 may query whether boom joint angle is greater than or equal to a boom joint angle corresponding to end of capture. If in step 164, boom joint angle criteria for end of capture are not satisfied, process 100 may return to step 162, after step 165 wherein boom up command is stopped. If yes, process 100 may return to step 162.

Step 170 may include increasing a bucket-curl command to capture work material. From step 170, process 100 may proceed to step 172 wherein electronic controller 30 may query whether bucket angle is at a desired world bucket angle for end of capture. If no, process 100 may return to repeat step 172. If yes, process 100 may proceed ahead to step 173 to stop the bucket curl command, then to step 174 to query whether bucket tip height is at a bucket tip height corresponding to end of capture. If no, process 100 may return to step 172. If yes, process 100 may proceed ahead to step 179. At step 179, electronic controller 30 may query whether either condition of steps 162 and 174 has been reached.

From step 179, process 100 may proceed to step 186. In step 186, electronic controller 30 may query whether a full cycle is on. In other words, electronic controller 30 may query whether automation of an entire work cycle is to be carried out, or whether only the digging portion of the work cycle will be controlled as described herein, and the rest controlled via manual control or a different control routine. If no, process 100 may return via step D to step 123. If yes, process 100 may proceed to step 188 wherein electronic controller 30 will output a swing-to-dump command, increasing a swing command in an appropriate direction to swing actuators (not shown) associated with boom 16. From step 188, process 100 may proceed to step 190 wherein electronic controller 30 may query whether a difference between a bucket swing angle and a set point for the bucket which corresponds to a dump position is very small. If no, process 100 may return to step 190. In other words, in step 190 electronic controller 30 may determine whether bucket position is relatively close to a desired dump position. If yes, process 100 may proceed to step 192 wherein electronic controller 30 will stop the swing command to avoid a hard stop. From step 192, process 100 will proceed to step 193 to set a desired bucket rack command, the beginning of a dump portion of the work cycle. Thenceforth, process 100 may proceed to step B and to step 194, to query whether bucket 20 is at a full rack position. Multiple bucket racking actions may be taken, if desired.

If at step 194, bucket 20 is not at a full rack position, process 100 may return to repeat step 194. From step 194, process 100 may proceed to step 195, to query whether another rack is required. If yes, process 100 may proceed to step 196 to set a desired bucket curl command, then to step 197 to query whether bucket joint angle is at a desired position. If no, process 100 may repeat step 197. If yes, process 100 may return via step F to step 193. Where step 195 is false, process 100 may proceed ahead to a plurality of parallel subroutines. In general, between steps 200 and 250, a Finish, each of the subject components of implement system 14 may be controlled to reposition bucket 20 and boom 16 and stick 18 in preparation for another dig.

In step 200, electronic controller 30 may set a swing command to swing actuators to return boom 16 toward the trench. From step 200, process 100 may proceed to step 202 wherein electronic controller 30 may query whether bucket 20 is close to the trench. If no, process 100 may proceed to step 205. If yes, process 100 may proceed to step 204 to set the swing command for an easy stop, and thenceforth to step 205. In step 205, electronic controller 30 may query whether bucket 20 is over the trench. If no, process 100 may proceed to step 206, to stop the swing command.

In step 210, electronic controller 30 may output a boom down command to return bucket 20 towards a trench floor. From step 210, process 100 may proceed to step 213 wherein electronic controller 30 may query whether bucket 20 is close to ground. If yes, process 100 may proceed to step 215 to query whether bucket 20 is over the trench. If at step 215, bucket 20 is not over the trench, the boom down command will be stopped via step 212 and process 100 will return to step 213. If the bucket is over the trench at step 215, process 100 may proceed ahead to step 216. From step 213, if bucket 20 is not close to the ground, process 100 may also proceed to step 216 wherein electronic controller 30 may query whether boom joint angle is greater than or equal to a desired boom joint angle. If no, process 100 may proceed to step 217 to set a boom down command, if the boom is stopped. If yes, from step 216, process 100 may proceed to step 218 to stop the boom down command, and thenceforth to step 219. From step 217, process 100 may proceed to step 219 wherein electronic controller 30 will query whether bucket 20 is stopped. If no, process 100 may return to step 213. If yes, process 100 may proceed ahead to step 249.

At step 220, electronic controller 30 may query whether bucket 20 is at a proper dig angle. If yes, process 100 may proceed to step 222 to determine whether boom 16 and stick 18 are at desired dig angles. If at step 220 bucket 20 is not at a proper dig angle, process 100 may proceed to step 224 to adjust the bucket curl command to achieve a proper dig angle. From step 224, process 100 may return to step 220. If at step 222, boom 16 and stick 18 are at desired dig angles, process 100 may proceed to step 249. If no, process 100 may proceed to step 226 wherein electronic controller 30 will query whether bucket tip height is at a desired height. If no, process 100 may return to step 220. If yes, process 100 may proceed ahead to step 249.

In step 230, electronic controller 30 may increase the stick command to adjust stick 18 toward a desired angle. From step 230, process 100 may proceed to step 232 wherein electronic controller 30 will query whether bucket 20 is close to the ground. If yes, process 100 may proceed to step 234 wherein electronic controller 30 may query whether bucket 20 is over the trench. If yes, process 100 may proceed ahead to step 238. If no, process 100 may proceed to step 236 wherein the stick command is stopped, and thenceforth return to step 232. From step 232, if bucket 20 is determined to not be close to the ground, process 100 may proceed to step 238. In step 238, electronic controller 30 may query whether stick joint angle is at a desired angle. If no, process 100 may proceed to step 239 wherein electronic controller 30 will set the stick command toward a desired angle if stopped. From step 239, process 100 may proceed to step 240 to query whether bucket tip velocity is stopped. If yes, process 100 may proceed to step 249. If no, process 100 may return to step 232. From step 238, if stick joint angle is at a desired angle, process 100 may proceed to step 242 to stop the stick command, and thenceforth proceed to step 240. All of steps 219, 226 and 240 may lead to step 249, wherein electronic controller 30 will query whether any of the respective conditions has been reached, and thenceforth to Finish at step 250.

The present disclosure offers numerous advantages over earlier strategies, such as force feedback control strategies, for automated work cycles. The use of velocity based control represents an insight into what parameters are of importance in successfully controlling an automated work cycle, while being applicable to different material types and transportable to different machines. It should be appreciated that while many of the features of the present control process will be implemented on different machines and in different material types, users may specify a variety of inputs to the control process in accordance with their preferences and desired operating characteristics. For instance, during a typical digging cycle, a swing angle to dump and a dump height may be specified by a user. A swing angle for a position of the trench, a ground height at which trench digging begins, and a final digging depth and/or number of digging passes may also be specified. The relative maximum and minimum displacements for actuators 17, 19 and 21 may also be specified, for example as a percent of a maximum, as well as bucket insertion, digging and heeling angles.

The present description is for illustrative purposes only, and should not be construed to narrow the breadth of the present disclosure in any way. Thus, those skilled in the art will appreciate that various modifications might be made to the presently disclosed embodiments without departing from the intended spirit and scope of the present disclosure. For example, while at least several parameters will typically be controlled during a digging portion of a work cycle, the present disclosure is not thereby limited. In one alternative embodiment, rather than controlling velocity of each of actuators 17, 19 and 21, velocity based control might be applied to only one actuator without departing from the scope of the present disclosure. Other aspects, features and advantages will be apparent from an examination of the attached drawings and appended claims.

What is claimed is:

1. A method of controlling a machine having an implement system including a linkage and a bucket coupled with the linkage, comprising the steps of:

moving the implement system through a work cycle that includes interacting with a material;

sensing values associated with a bucket velocity parameter during interacting with material; and controlling the bucket velocity parameter by controlling a sequence of bucket orientations whereby the implement system interacts with the material;

wherein the step of controlling the bucket velocity parameter includes outputting actuator control commands for at least one actuator of the implement system with an electronic controller of the machine, responsive to a hardness of the material indicated by the sensed values.

2. The method of claim 1 wherein the machine comprises an excavating machine, and wherein the moving step comprises moving the implement system through an automated digging cycle.

3. The method of claim 2 wherein the sequence of bucket orientations whereby the implement system interacts with material defines a bucket tip path, and wherein the step of controlling the bucket velocity parameter comprises outputting commands to at least one actuator of the implement system to control the bucket tip path during interacting with material.

4. The method of claim 2 wherein:

the step of sensing values associated with a bucket velocity parameter further comprises the steps of sensing values indicative of boom actuator velocity, sensing values indicative of stick actuator velocity and sensing values indicative of bucket actuator velocity;

the method further comprises a step of determining a bucket tip velocity based on the sensed values; and the step of controlling the bucket velocity parameter includes outputting velocity commands to actuators for the implement system to vary a sequence of bucket orientations whereby the implement system interacts with material responsive to the determined bucket tip velocity.

5. The method of claim 2 wherein the step of controlling the bucket velocity parameter further comprises the steps of, controlling a boom-up parameter and controlling a bucket-curl parameter.

6. The method of claim 5 wherein the step of controlling the bucket velocity parameter further comprises a step of controlling a digging pass distance of the bucket through the material responsive to the sensed values.

7. The method of claim 6 wherein the step of controlling the bucket velocity parameter further comprises the steps of:

commanding relatively faster bucket-curl and relatively slower boom-up in the digging cycle, if the material is relatively softer; and commanding relatively slower bucket-curl and relatively faster boom-up in the digging cycle, if the material is relatively harder.

8. The method of claim 7 wherein the step of moving the implement system comprises incrementally decreasing at least one of boom-up and bucket-curl commands, if bucket tip velocity is above a desired velocity.

9. The method of claim 2 further comprising a step of determining a target bucket tip velocity for moving the implement system in the automated digging cycle, based at least in part on a power interaction of the bucket with material.

10. A machine comprising:

an implement system that includes a linkage having a boom and a stick, a bucket, and a plurality of actuators;

at least one sensor configured to sense values associated with a bucket velocity parameter; and an electronic controller coupled with said at least one sensor and with each of said actuators, said electronic controller being configured to control the bucket velocity parameter by controlling a sequence of bucket orientations whereby the implement system interacts with a material responsive to a hardness of the material indicated by signals from said at least one sensor.

11. The machine of claim 10 wherein said at least one sensor comprises a sensor group including a plurality of sensors coupled one with each of said plurality of actuators, said electronic controller being configured to control bucket tip velocity responsive to a material hardness indicated by inputs from said plurality of sensors.

12. The machine of claim 10 comprising an excavating machine.

13. The machine of claim 12, wherein said electronic controller is configured via an automated digging cycle control algorithm to control the bucket velocity parameter via commands to at least one of said actuators to vary a sequence of bucket orientations in a digging portion of an automated digging cycle.

14. The machine of claim 13 wherein said plurality of actuators includes a boom actuator, a stick actuator and a bucket actuator, wherein said plurality of sensors includes a boom sensor, a stick sensor and a bucket sensor, and wherein said electronic controller is further configured via said control algorithm to determine bucket tip velocity based on inputs from said sensors and responsively output bucket-curl, stick-in and boom-up control commands to said bucket, stick and boom actuators to vary said sequence of bucket orientations responsive to determined bucket tip velocity.

15. The machine of claim 14 wherein said electronic controller is further configured via said control algorithm to command relatively faster bucket-curl and relatively slower boom-up, where bucket tip velocity is relatively greater, and configured to command relatively slower bucket-curl and relatively faster boom-up where bucket tip velocity is relatively less.

16. A control system for an excavating machine having an implement system that includes a linkage with a boom and stick, and a bucket, said control system comprising:

at least one sensor configured to output signals indicative of a bucket velocity parameter; and an electronic controller coupled with said at least one sensor, said electronic controller being configured to control the bucket velocity parameter by controlling a sequence of bucket orientations whereby said implement system interacts with a material responsive to a hardness of the material indicated by signals from said at least one sensor.

17. The control system of claim 16 wherein said at least one sensor is configured to output signals indicative of bucket tip velocity, said electronic controller being configured to determine bucket tip velocity based on said signals, said electronic controller being further configured to output a sequence of velocity commands to at least one actuator of the implement system during digging material with said bucket, and configured to vary velocity commands within the sequence responsive to determined bucket tip velocity.

18. A control system for an excavating machine having an implement system that includes a linkage with a boom and stick, and a bucket, said control system comprising:

at least one sensor configured to output signals indicative of a bucket velocity parameter; and an electronic controller coupled with said at least one sensor, said electronic controller being cg to control the bucket velocity parameter by controlling a sequence of bucket orientations whereby said implement system interacts with material responsive to signals from said at least one sensor;

wherein said at least one sensor is configured to output signals indicative of bucket tip velocity, said electronic controller being configured to determine bucket tip velocity based on said signals, said electronic controller being further configured to output a sequence of velocity commands to at least one actuator of the implement system during digging material with said bucket, and configured to vary velocity commands within the sequence responsive to determined bucket tip velocity; and wherein said electronic controller is further configured to output increased velocity commands to a bucket actuator of the implement system where bucket tip velocity is relatively greater and output decreased velocity commands to a bucket actuator where bucket tip velocity is relatively less.

19. The control system of claim 18 wherein said electronic controller is further configured to output decreased velocity commands to a boom actuator where bucket tip velocity is relatively greater and output increased velocity commands to the boom actuator where bucket tip velocity is relatively less.

* * * * *